US006029640A

United States Patent [19]

Bengtsson et al.

[11] Patent Number: 6,029,640

[45] Date of Patent: Feb. 29, 2000

[54] METHOD OF DETECTING AN IONIZATION CURRENT

[75] Inventors: Jörgen Bengtsson, Svanskog; Lars-Olof Ottosson, Åmål, both of Sweden

[73] Assignee: SEM AB, Amal, Sweden

[21] Appl. No.: 09/202,254

[22] PCT Filed: Jun. 11, 1997

[86] PCT No.: PCT/SE97/01022

§ 371 Date: Dec. 10, 1998

§ 102(e) Date: Dec. 10, 1998

[87] PCT Pub. No.: WO97/47875

PCT Pub. Date: Dec. 18, 1997

[30] Foreign Application Priority Data

Jun. 12, 1996 [SE] Sweden ..... 9602318

[51] Int. Cl.[7] ..... F02P 1/00

[52] U.S. Cl. ..... 123/599; 123/630; 324/382

[58] Field of Search ..... 123/599, 630; 324/382

[56] References Cited

U.S. PATENT DOCUMENTS

| | | | |
|---|---|---|---|
| 3,906,919 | 9/1975 | Asik et al. . | |
| 4,285,321 | 8/1981 | Phelon et al. | 123/599 |
| 4,428,333 | 1/1984 | Erhard | 123/599 |
| 4,449,497 | 5/1984 | Wolf et al. | 123/599 |
| 4,478,200 | 10/1984 | Nagashima et al. | 123/599 |
| 4,565,179 | 1/1986 | Nytomt et al. | 123/599 |
| 4,718,394 | 1/1988 | Honjoh et al. | 123/599 |
| 5,146,905 | 9/1992 | Davis | 123/599 |
| 5,507,264 | 4/1996 | Kugler et al. | 123/630 |
| 5,775,310 | 7/1998 | Ito et al. | 123/680 |

FOREIGN PATENT DOCUMENTS

| | | |
|---|---|---|
| 0 260 177 A1 | 8/1987 | European Pat. Off. . |
| 0 652 366 A2 | 11/1994 | European Pat. Off. . |
| 0 752 580 A2 | 7/1996 | European Pat. Off. . |

*Primary Examiner*—John Kwon

*Attorney, Agent, or Firm*—Ware, Fressola, Van der Sluys & Adolphson LLP

[57] ABSTRACT

A method for generation of a low test voltage is used for the purpose of detecting an ionization current in the spark gap of an internal combustion engine. The voltage is generated by a controllable ignition magneto (5) arranged in order to charge (2) an ignition capacitor (4). The voltage is applied (3) to the primary side of the ignition device after generation of a spark and after the decay of the spark, after which the ionization current is detected (11) on the secondary side of the ignition device.

16 Claims, 1 Drawing Sheet

METHOD OF DETECTING AN IONIZATION CURRENT

BACKGROUND OF THE INVENTION

1. Technical Field

The present invention relates to a method for the generation of a voltage for the purpose of detecting an ionization current in the spark gap of an internal combustion engine. The detection is supposed to take place after the ignition of the spark and after the decay of the spark.

2. Description of the Prior Art

It is known that the combustion of an air/fuel mixture in an internal combustion engine results in the production of ions. These ions can be detected by applying a voltage across the spark gap with the result that an ionization current is generated. This ionization current can be measured and used for the detection of misfire, knock, missing combustion, combustion quality and so on, of the engine.

The measurement of the ionization current attained in the spark gap can take place either on the high tension side of the spark device or on the low tension side.

On the high tension side, a measurement problem is the difficulty of handling the generated voltage (up to about 50 kV) by means of commercially available electronic components. Due to these problems the ionization current measurement takes place on the low tension side of the spark device today. According to this method there are problems as well, that is to say component tolerance problems and leakage currents coming into existence in components and coils and causing interpretation uncertainty of the measurements carried out. Furthermore, the spark itself disturbs the measurements of the ionization current when the spark current and ionization current are time-connected to each other, and the differences of the amplitudes are about 1000 times. Another problem is that the ionization current amplitude is influenced by gasoline additives.

The technique of today for the purpose of measuring an ionization current is based on the discharge of a DC voltage of about 100 V being stored in a capacitor arranged for that purpose in the secondary circuit of the ignition device, which DC voltage is discharged via the spark device in connection with the generation of the spark. This voltage gives rise to a varying ionization current, where the ion current level depends on the number of free ions. A change of the number of the ions changes the conductivity between the electrodes.

Ignition knock, misfire, combustion quality and so on can be read from the ionization current by means of signal processing, such as frequency separation and other mathematical signal processing.

BRIEF DESCRIPTION OF THE INVENTION

The object of the invention is to generate an ionization current in the spark gap of an internal combustion engine and solve the problems mentioned above relating to the electronic components and the effect from the spark current. After signal processing, the detection of knock, misfire, combustion quality and so on can be accomplished by means of this ionization current. According to the invention, the ionization current is generated by applying a low voltage across the spark gap, which has to be done after the decay of the generated spark so that the spark does not disturb the measurement of the ionization current. The voltage is applied by means of an ignition magneto, for example a high frequency oscillator. It is known to arrange an ignition magneto in a capacitive ignition system in order to charge a charging capacitor. See our Swedish patent application No. 9501259-7. According to the invention, this ignition magneto is also used to generate said voltage for the purpose of generating an ionization current. The voltage is applied across the spark gap by means of the secondary coil of the ignition device or across a specially arranged winding. The ionization current generated is detected on the low tension side of the secondary side of the ignition device.

The invention will be explained by means of examples of embodiments shown in the drawing.

DESCRIPTION OF EMBODIMENT OF THE INVENTION

Figure 1:
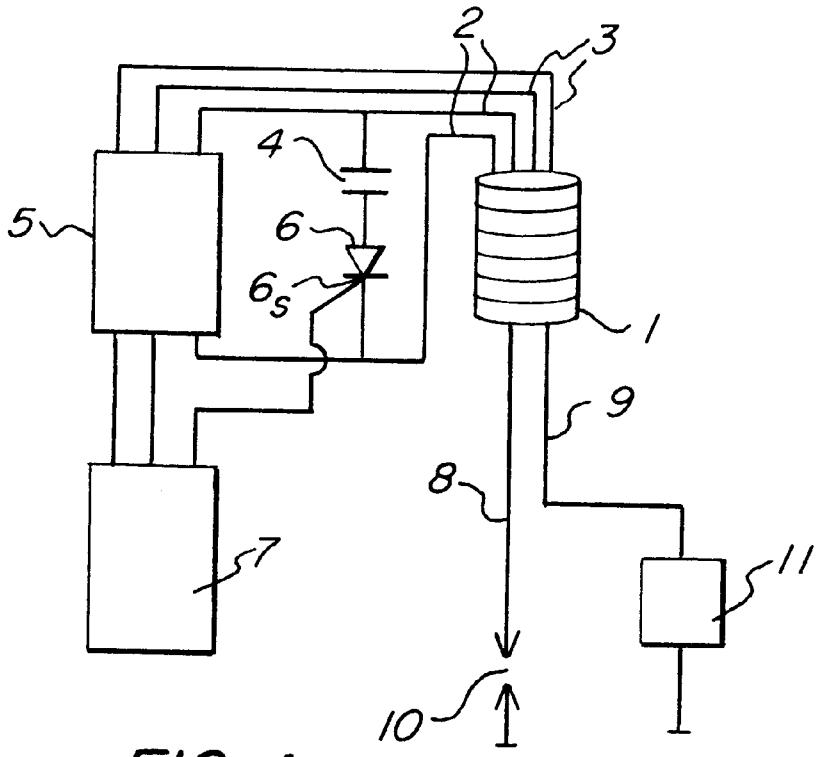
FIG. 1 indicates a system for the generation of a tension according to the invention.
Figure 2:
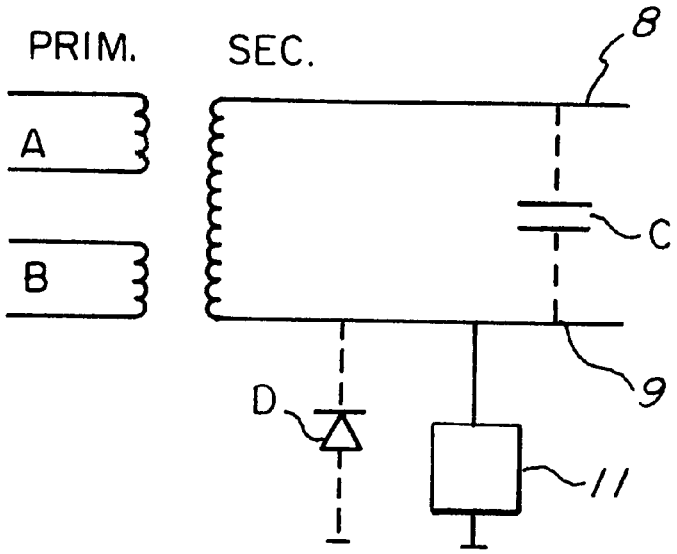
FIG. 2 indicates an ignition coil and a measuring circuit for the ionization current according to the invention.

FIG. 1 indicates a capacitive ignition system of an internal combustion engine. The invention can also be used in inductive ignition systems. 1 indicates an ignition coil with a connection 2 to a first primary winding A and a connection 3 to a second primary winding B, which is arranged specially for said purpose. A charging capacitor 4, preferably having a low capacity, is connected to the connection 2 of the first primary winding. A The charging capacitor 4 is also connected to an ignition magneto 5, for example a high frequency oscillator, in order to give a short high energy spark being able to ignite the fuel mixture. The connection 3 of the second primary winding B is connected to high frequency oscillator 5 to make it possible also to use the high frequency oscillator 5 as a low tension source for the generation of the ionization current. The discharge of the charging capacitor 4 is controlled by a thyristor 6 or the like, the control electrode $\mathbf{6}_s$ of which is connected to an electrical control unit 7. The control unit 7 is also connected to the high frequency oscillator 5. The aforementioned components are known as such, and therefore their constructions or functions do not have to be described here. On the secondary side of the ignition coil 1, there is a connection 8 on the high tension side to a spark plug 10, and on the low tension side there is a connection 9 to ground with measuring circuits 11 for the measurement of the ionization current.

The system works as follows. The charging capacitor 4 is discharged by triggering the thyristor 6 which is controlled by means of the control unit 7. The discharge results at a spark in the spark plug, after which ions are produced by the combustion of the air/fuel mixture in the combustion space. After the decay of the spark, an oscillating low tension is applied to the primary side of the ignition coil, by means of the high frequency oscillator 5, to a special winding B connected to the ignition coil. The reason for using different primary windings A, B is to increase the accuracy of the measurement signal, which signal thereafter is measured at the secondary winding of the ignition device. If the primary/secondary ratio is 1/100 an eventual inaccuracy is amplified about 100 times when controlling the primary voltage. The applied low tension produces a current which depends on the number of ions produced in connection with the combustion. Both the charging circuit 4, 6 and the ignition coil 1 must be very fast and therefore high frequency can be used in the charging circuit.

The amplitude of the ionization current is influenced by additives in the gasoline. By changing the applied ion measuring voltage, the ionization current can be adapted to the right basic level for all types of fuel.

A control of the amplitude of the applied low tension for the generation of an ionization current is accomplished by the control unit 7. A control of the duration and the timing of the application, i.e. the timing for the "connection" of the ionization current, are also arranged by the control unit 7. This timing must be chosen so that disturbances of the measurement do not arise from the oscillating spark current generated by the ignition of the spark. So, the spark current should be decayed prior to the connection of the ionization measuring voltage.

The generated ionization current is detected on the low tension side 9 of the spark device in a separate measuring circuit 11 which is coupled to the connection 9. The ionization measuring voltage can be rectified (D) and smoothed by means of distributed capacitances (C) occurring in the ignition coils of the ignition device, or by means of separate distributed capacitances specially placed in the coil.

It is obvious for the man skilled in the art that the embodiment shown is only an example of the invention. The invention is only restricted by the characteristics given in the claims.

We claim:

1. A method for the generation of a voltage for detecting an ionization current in a spark gap of an internal combustion engine, comprising the steps of:

(a) providing a controllable ignition magneto on a primary side of an ignition device in order to charge an ignition capacitor;

(b) igniting a spark in the spark gap;

(c) after decay of the spark, connecting the ignition magneto to a special primary winding on the primary side, as a low-tension source, so as to generate an ionization measuring voltage; and (d) detecting an ionization current on a low-tension side of a secondary side of the ignition device.

2. A method according to claim 1, further including the step of controlling amplitude of the ionization measuring voltage.

3. A method according to claim 2, further including the step of controlling duration of the ionization measuring voltage.

4. A method according to claim 3, further including the step of controlling timing for connection of the ionization measuring voltage so as to eliminate measurement disturbances originating from the spark and the decay of the spark.

5. A method according to claim 4, further including the step of maintaining the ionization measuring voltage on a DC level by means of distributed capacitances in ignition coils of the ignition device.

6. A method according to claim 5, further including the step of creating special distributed capacitances to be used for generation of the ionization measuring voltage.

7. A method according to claim 1, further including the step of controlling duration of the ionization measuring voltage.

8. A method according to claim 7, further including the step of controlling timing of connection of the ionization measuring voltage so as to eliminate measurement disturbances originating from the spark and the decay of the spark.

9. A method according to claim 8, further including the step of maintaining the ionization measuring voltage on a DC level by means of distributed capacitances in ignition coils of the ignition device.

10. A method according to claim 9, further including the step of creating special distributed capacitances to be used for generation of the ionization measuring voltage.

11. A method according to claim 1, further including the step of controlling timing of connection of the ionization measuring voltage so as to eliminate measurement disturbances originating from the spark and the decay of the spark.

12. A method according to claim 11, further including the step of maintaining the ionization measuring voltage on a DC level by means of distributed capacitances in ignition coils of the ignition device.

13. A method according to claim 12, further including the step of creating special distributed capacitances to be used for generation of the ionization measuring voltage.

14. A method according to claim 1, further including the step of maintaining the ionization measuring voltage on a DC level by means of distributed capacitances in ignition coils of the ignition device.

15. A method according to claim 14, further including the step of creating special distributed capacitances to be used for generation of the ionization measuring voltage.

16. A method according to claim 1, further including the step of creating special distributed capacitances to be used for generation of the ionization measuring voltage.

* * * * *

UNITED STATES PATENT AND TRADEMARK OFFICE

CERTIFICATE OF CORRECTION

PATENT NO. : 6,029,640
DATED : February 29, 2000
INVENTOR(S) : Jorgen Bengtsson and Lars Olof-Ottosson It is certified that error appears in the above-identified patent and that said Letters Patent is hereby corrected as shown below:

In column 2, line 29, "winding.A" should be --winding A.--.

In column 2, line 59, after "1/100", --,-- should be inserted.

In column 2, line 67, "ion" should be --ionization--.

Signed and Sealed this

Sixth Day of February, 2001

*Attest:*

*Attesting Officer*

Q. TODD DICKINSON

*Director of Patents and Trademarks*